US008333457B2

(12) United States Patent
Maruoka et al.

(10) Patent No.: US 8,333,457 B2
(45) Date of Patent: Dec. 18, 2012

(54) DECORATIVE PRINTING METHOD

(75) Inventors: Yosuke Maruoka, Kiyosu (JP); Takashi Sekiya, Kiyosu (JP); Daiichiro Kawashima, Kiyosu (JP)

(73) Assignee: Toyoda Gosei Co., Ltd., Aichi-pref (JP)

( * ) Notice: Subject to any disclaimer, the term of this patent is extended or adjusted under 35 U.S.C. 154(b) by 144 days.

(21) Appl. No.: 13/023,558

(22) Filed: Feb. 9, 2011

(65) Prior Publication Data

US 2011/0211017 A1 Sep. 1, 2011

(30) Foreign Application Priority Data

Feb. 26, 2010 (JP) ..... 2010-041555

(51) Int. Cl.
*B41J 2/21* (2006.01)

(52) U.S. Cl. ..... 347/43

(58) Field of Classification Search ..... 347/12, 347/15, 40, 43
See application file for complete search history.

(56) References Cited

U.S. PATENT DOCUMENTS

2006/0050095 A1 3/2006 Kakuno et al.

FOREIGN PATENT DOCUMENTS

| | | | |
|---|---|---|---|
| JP | 06-293142 | A | 10/1994 |
| JP | 09-193368 | A | 7/1997 |
| JP | 2006-75253 | A | 3/2006 |
| JP | A-2007-003304 | | 1/2007 |
| JP | 2008-246855 | A | 10/2008 |
| JP | A-2009-285625 | | 12/2009 |
| JP | A-2009-297626 | | 12/2009 |

OTHER PUBLICATIONS

Office Action dated May 9, 2012 in corresponding JP Application No. 2010-041555.

*Primary Examiner* — Lamson Nguyen
(74) *Attorney, Agent, or Firm* — Posz Law Group, PLC

(57) ABSTRACT

The present invention is used for a printing target having a non-flat surface portion in at least a portion of a printing surface. To form a decorative printing film on the printing surface of a base material, ink droplets of the same color as the color of the printing film are ejected from nozzles of an inkjet printer onto the printing surface. The distance from the nozzles to the printing surface is represented by X (mm). The droplet amount of the ink is represented by Y (pl). When the maximum value of the distance X is greater than 5 mm, the droplets are ejected from the nozzles each by an amount greater than the droplet amount Y represented by the equation: $Y=0.9X^{1.5}$.

5 Claims, 5 Drawing Sheets

Fig.2
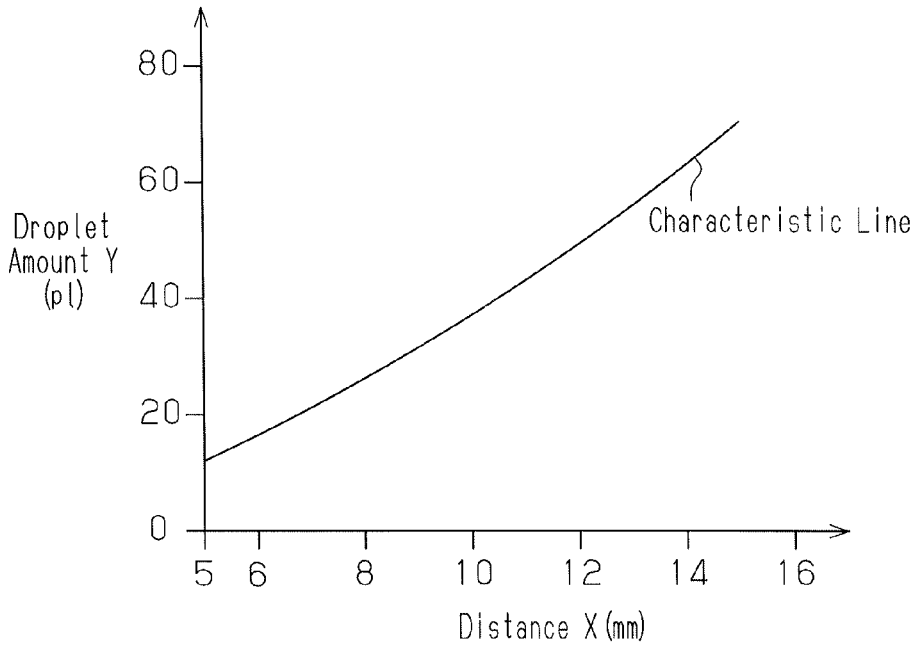
Fig.3A
Fig.3B
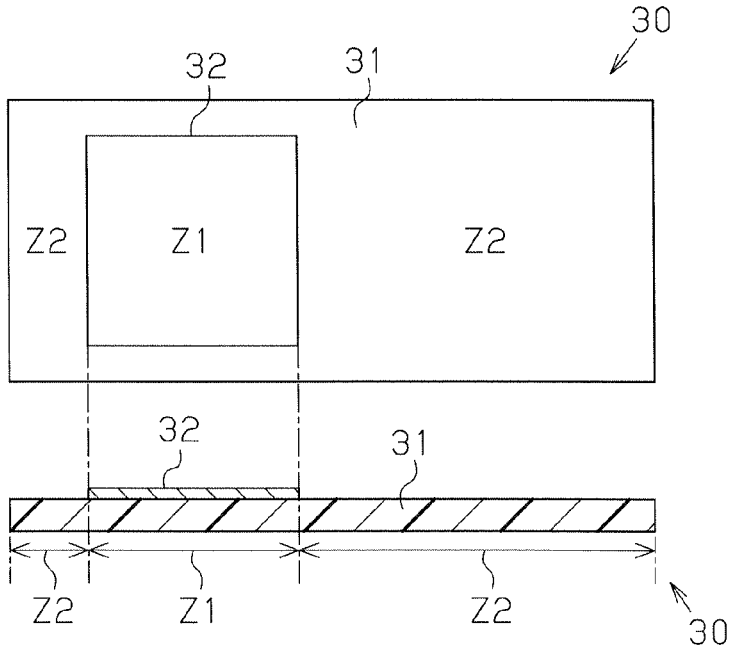

DECORATIVE PRINTING METHOD

BACKGROUND OF THE INVENTION

The present invention relates to a method of decorative printing on a base material having a non-flat front surface through inkjet printing.

Vehicles include decorative members such as ornaments, emblems, and front grill garnishes. These decorative members employ a base material formed of transparent resin. The base material includes a front surface serving as a decorative surface and a back surface serving as a printing surface. A printing film is formed on the printing surface so as to be visible from the front surface of the decorative member through the base material.

To form a printing film, a screen printing method is typically employed. In a screen printing method, a squeegee is moved along a screen under pressure to squeeze ink out from the screen, thus applying the ink onto a printing surface. However, as more colors are used, more steps have to be carried out in the printing method to apply the ink onto the printing surface and cure the ink. Also, since the ink remains on the screen after printing, an excessive amount of ink is necessary, thus raising costs.

Further, screen printing is difficult to perform unless the printing surface is a flat surface or a curved surface having a uniform curvature. For example, if the printing surface includes a recessed portion, it is impossible to move the squeegee under pressure with the screen maintained close to the printing surface.

To solve this problem, it was thought to form a printing film by an inkjet printing method. In the inkjet printing method, ink droplets of different colors are ejected onto a printing surface. Then, ultraviolet rays, for example, are radiated onto the droplets to cure the droplets on the printing surface. This allows comparatively easy printing with fewer steps, using less ink, and regardless of the shape of the printing surface.

The inkjet printing method was originally designed to be performed on a flat printing surface, such as a sheet of paper. In this case, as illustrated in FIG. 8, an ink head 50 includes a plurality of ejecting portions 51 each including a nozzle 52. Each of the nozzles 52 moves while maintained close to a printing surface 53 of a decorative member 55. The distance X from the nozzles 52 to the printing surface 53 is constant throughout the area corresponding to the printing surface 53 and, specifically, 1 to 2 mm. In other words, droplets 54 ejected through each nozzle 52 travel over a short distance in a short time. As a result, the droplets 54 are unsusceptible to influence by the air or wind. This allows the droplet 54 to reach a target position on the printing surface 53 relatively accurately, as indicated by the lines in FIG. 8 composed of a long dash alternating with two short dashes lines. At this stage, the droplets 54 reach the position with limited variation.

Even if the printing surface 53 is a non-flat surface, that is, for example, a golf ball having slightly recessed portions in a surface is an object for printing on, as described in Japanese Laid Open Patent Publication No. 2006-75253, the distance from nozzles to the printing surface is short even for a portion corresponding to the bottom of each of the recessed portions. This ensures an advantage similar to the above-described advantage.

However, vehicle decorative members such as vehicle ornaments, emblems, or front grill garnishes each include both an area in which the distance X from the corresponding nozzle 52 to the printing surface 53 is short as indicated in FIG. 9 by the line composed of a long dash alternating with two short dashes line and an area in which the distance X from the nozzle 52 to the printing surface 53 is long as indicated by a solid line in the drawing. In this case, for the area corresponding to the shorter X distance, each droplet 54 travels over a short distance in a short time to reach the printing surface 53. This limits the influence on the droplets 54 by the resistance of air or wind, thus reducing the size of the variation range R of a droplet receiving position at which the droplets 54 are received by the printing surface 53.

However, as the distance X from each nozzle 52 to the printing surface 53 increases, the distance and the time for which each droplet 54 travels to reach the printing surface 53 increase. Accordingly, in correspondence with increase of the distance X, the influence on the droplet 54 by the resistance of air or wind increases to an extent that cannot be ignored. This may cause the droplets 54 to reach a position greatly offset from a target position on the printing surface 53, thus enlarging the variation range R of the droplet receiving position in excess of an acceptable range. As a result, the droplets 54 may reach a position outside a prescribed printing zone, thus causing an unclear boundary between the printing zone and a non-printing zone or between adjacent printing zones, that is, the definition of printing zones can blur.

SUMMARY OF THE INVENTION

Accordingly, it is an objective of the present invention to provide a decorative printing method that causes ink droplets to reach a target position on a printing surface and thus clarifies the definition of a printing zone.

To achieve the foregoing objective and in accordance with one aspect of the present invention, a decorative printing method for forming a printing film on a surface to be printed of a printing target formed by a base material is provided. The method includes ejecting droplets of ink having the same color as the color of the decorative printing film from nozzles of an inkjet printer onto the surface to be printed to form the printing film, in which a non-flat surface portion forms at least a portion of the surface to be printed. The distance from each nozzle to the surface to be printed is represented by X (mm) and the amount of ink of each droplet is represented by Y (pl). The droplet amount Y is represented by the equation: $Y=0.9X^{1.5}$. When the maximum value of the distance X (mm) is greater than 5 mm, droplets each having an amount greater than the droplet amount Y are ejected from each nozzle.

BRIEF DESCRIPTION OF THE DRAWINGS

FIG. 2 is a graph representing the relationship between the distance from a nozzle to a printing surface and the droplet amount;

FIG. 3A is a plan view showing a printing sample employed to determine the relationship represented in FIG. 2;

FIG. 3B is a cross-sectional view showing the printing sample employed to determine the relationship represented in FIG. 2;

DETAILED DESCRIPTION OF THE PREFERRED EMBODIMENTS

One embodiment of a decorative printing method according to the present invention will now be described with reference to FIGS. 1 to 7B.

First, a printing target of the decorative printing method according to the invention will be described.

As a printing target having a non-flat surface (a three-dimensional surface) such as a curved surface, a bent surface, or a surface recesses and projections, there is a vehicle decorative member, which is, for example, an ornament, an emblem, or a front grill garnish. The ornament is mounted in the front grill of a vehicle and is referred to also as a millimeter-wave radar garnish. The ornament is arranged in front of and in the proximity of a millimeter wave radar device used in an automatic cruise system. The ornament represents the name of the manufacturer or the marque of the vehicle (brand or make). The marque may be a character (or characters) or an image or a combination thereof. The description herein will refer to the ornament as a printing target by way of example.

Figure 1:
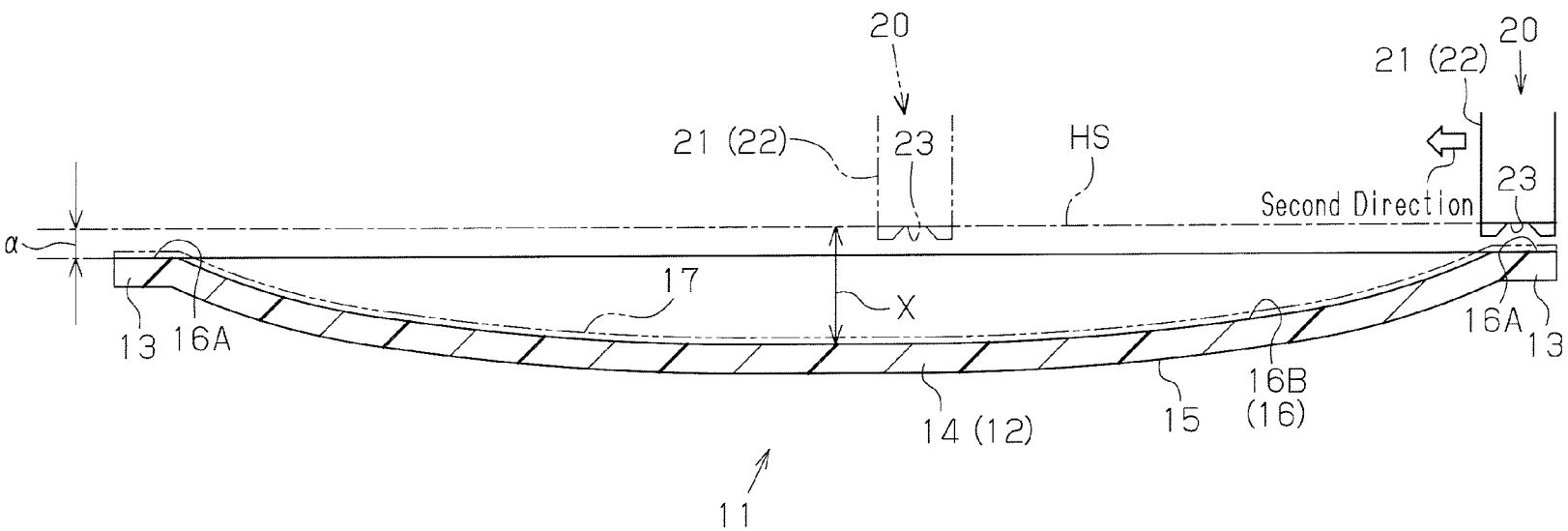
FIG. 1 is a cross-sectional view showing a decorative member subjected to decorative printing.

As illustrated in FIG. 1, a major portion of an ornament 11 is formed by a base material 12. The base material 12 is formed of synthetic resin with low ink permeability. The base material 12 is formed of transparent polycarbonate.

The base material 12 is formed by a peripheral portion 13 and a body portion 14 encompassed by the peripheral portion 13. The peripheral portion 13 is formed flat and shaped annularly. The peripheral portion 13 as a whole is shaped like a dish. The body portion 14 is formed in a projected shape, slightly projecting in the direction of the thickness of the base material 12 (in a downward direction as viewed in FIG. 1). The front surface of the base material 12 corresponds to the projecting side of the body portion 14 (a lower surface as viewed in FIG. 1). The back surface of the base material 12 corresponds to the side opposite to the projecting side of the base material 12 (an upper surface as viewed in the drawing). The front surface of the base material 12 forms a decorative surface 15 of the ornament 11. The back surface of the base material 12 forms a printing surface 16. Hereinafter, the portion of the printing surface 16 corresponding to the peripheral portion 13 will be referred to as a flat surface portion 16A and the portion of the printing surface 16 corresponding to the body portion 14 will be referred to as a non-flat surface portion 16B so as to distinguish between the two portions. The flat surface portion 16A is shaped as a flat surface and the non-flat surface portion 16B is concave. The maximum depth of the non-flat surface portion 16B is approximately 10 mm (which may be, for example, 8 mm). The non-flat surface portion 16B may have a convex shape or a combination of a concave portion and a convex portion.

In the present embodiment, decorative printing is carried out using an inkjet printer 20. The inkjet printer 20 has an ink head 22 including a plurality of ejecting portions 21 (only one is shown in FIG. 1). The ejecting portions 21 operate in response to a command signal from a control device (not shown). Each of the ejecting portions 21 ejects droplets from a nozzle 23 onto the printing surface 16 of the base material 12 to form a decorative printing film 17 on the printing surface 16, as indicated by the lines formed by a long dash alternating with two short dashes line FIG. 1. The droplets are of an ultraviolet cure type pigment ink, which cures in an ultraviolet-sensitive manner.

In the present embodiment, ink droplets 24 having the same color as the printing film 17 are ejected from nozzles 23. In other words, the description herein excludes a case in which ink droplets 24 of multiple colors different from the color of the printing film 17 are ejected and mixed on the printing surface 16 to bring about the color of the printing film 17.

Ink may be ejected by a method such as a thermal method or a piezoelectric method. By the thermal method, ink in a tube is heated to produce bubbles and thus ejected. By the piezoelectric method, voltage is applied to a piezoelectric element mounted in a small tube having an ink chamber to cause deformation, thus ejecting ink from the ink chamber to the exterior of the tube. In the present embodiment, the ink is ejected by the piezoelectric method.

The ink ejected by the ejecting portions 21 is not of a single color (a single ink) but an ink mixture prepared by mixing ink of multiple colors in advance. For example, to form a blue printing film 17, the ink mixture is prepared by mixing cyan ink, magenta ink, and white ink.

The inkjet printer 20 includes a holding portion (not shown) for holding the base material 12 of the printing target 11. The holding portion maintains the peripheral portion 13 of the base material 12 in a horizontal state.

The inkjet printer 20 has a movement mechanism (not shown) for moving the ink head 22 on a horizontal plane HS spaced upward from the peripheral portion 13 of the base material 12 by a predetermined distance $\alpha$ (which is, for example, 2 mm). The ink head 22 is thus reciprocated in a first direction (the direction perpendicular to the sheet surface of FIG. 1) and moved in a second direction (the leftward direction as viewed in the drawing) perpendicular to the first direction. By moving the ink head 22 on the horizontal plane HS, the printing film 17, which has a prescribed pattern on it, is formed on the printing surface 16 of the base material 12, which is maintained in a fixed state.

Figure 6:
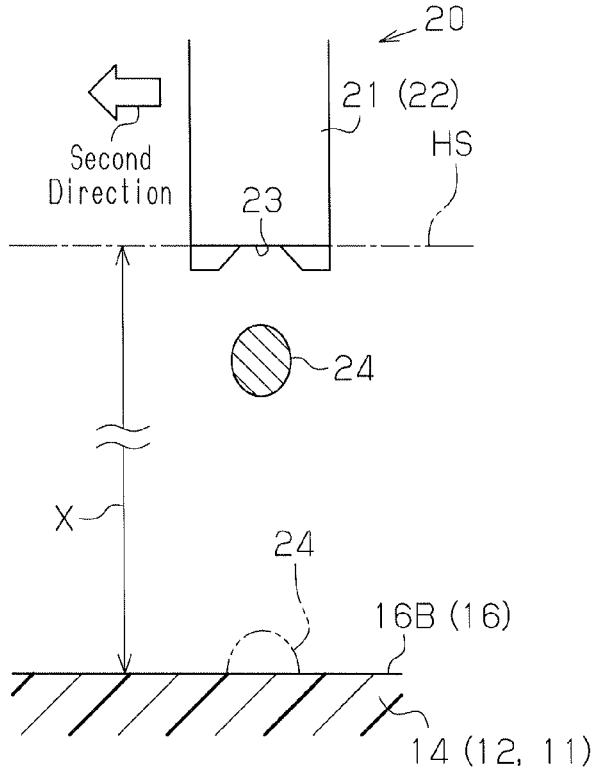
FIG. 6 is a cross-sectional view illustrating ink ejected from a nozzle onto a printing surface.

With reference to FIGS. 1 and 6, the distance X (mm) from the nozzles 23 to the printing surface 16 reaches a maximum at the deepest portion of the body portion 14. As set forth in CLAIMS, the relationship between the positions of the nozzles 23 and the position of the printing surface 16 is defined on the presumption that the maximum value of the distance X is greater than 5 mm.

In this case, the inkjet printer 20 is adjusted in such a manner as to eject droplets 24 by an amount greater than the droplet amount Y (pl) represented by equation (1), as described below, through the nozzle 23.

$$Y=0.9X^{1.5} \quad (1)$$

The adjustment is carried out by regulating the voltage applied to the piezoelectric element of each of the ejecting portions 21.

The above-described equation (1) is used to determine whether the droplet 24 ejected from the nozzle 23 has reached a target position on the printing surface 16. If the amount of the ejected droplet 24 is greater than the droplet amount Y obtained by the equation (1), the droplet 24 reaches a position in an acceptable range on the printing surface 16 including the target position. In contrast, if the amount of the ejected droplet 24 is smaller than or equal to the droplet amount Y determined by the equation (1), the droplet 24 reaches a position outside the acceptable range on the printing surface 16.

The equation (1) may be used not only for a single drop method by which one droplet 24 of the droplet amount Y (pl) is ejected from the nozzle 23 at one time, as in the case of the present embodiment, but also for a multiple drop method by which a droplet 24 of the droplet amount Y is ejected in a divided manner at multiple times. Specifically, by the multiple drop method, droplets of a small amount obtained by dividing the droplet 24 of the droplet amount Y into a plurality of smaller droplets are sequentially ejected from the nozzle 23. Normally, these smaller droplets join one another to form the droplet 24 of the droplet amount Y (pl) while traveling over a distance from 1 to 3 mm. If the distance X from the nozzles 23 to the printing surface 16 is greater than 5 mm, the smaller droplets of the small amount join one another by the time when they reach the point corresponding to the distance of 3 mm from the nozzle 23 to the printing surface 16. As a result, past this point, the droplet 24 of the aforementioned droplet amount Y travels. Accordingly, even by the multiple drop method, the droplet 24 reaches a position in the acceptable range on the printing surface 16, as in the case of the single drop method.

The equation (1) representing the relationship between the distance X and the droplet amount Y has been determined by the procedure described below.

(i) Preparation of Printing Sample 30

As illustrated in FIGS. 3A and 3B, a flat and transparent base material 31 with the thickness of approximately 3 mm was used. Nozzles were arranged at certain positions spaced from the base material 31 by an interval greater than 5 mm. Subsequently, ink droplets of a certain droplet amount were ejected from the nozzles onto the base material 31. Then, by curing the droplets on the base material 31, a printing film 32 was formed on the front surface of the base material 31. In this manner, a printing sample 30 was produced. Multiple combinations of the distance X and the droplet amount Y were considered and a printing sample 30 was produced for each of the combinations. FIG. 3A is a plan view showing the printing sample 30. FIG. 3B is a cross-sectional side view showing the printing sample 30.

(ii) Visual Evaluation

Figure 4:
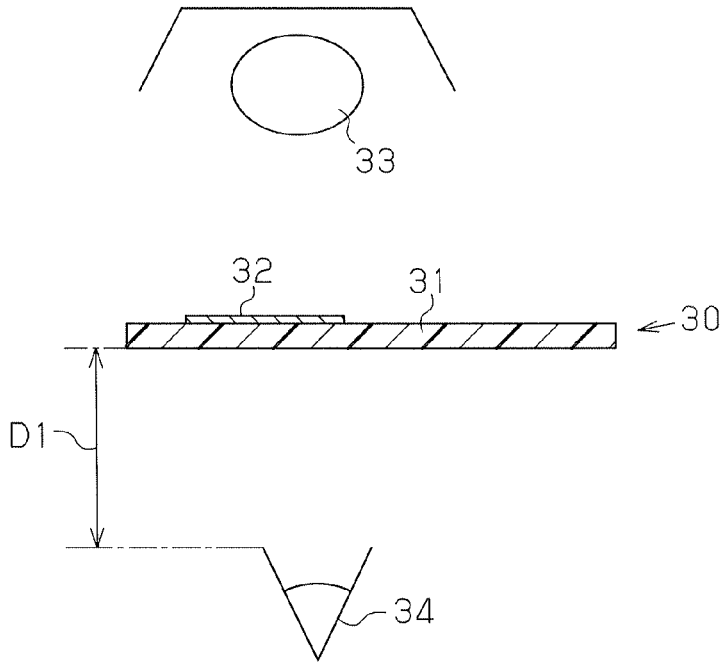
FIG. 4 is a cross-sectional view for describing a method for determining the relationship represented in FIG. 2.
Figure 5:
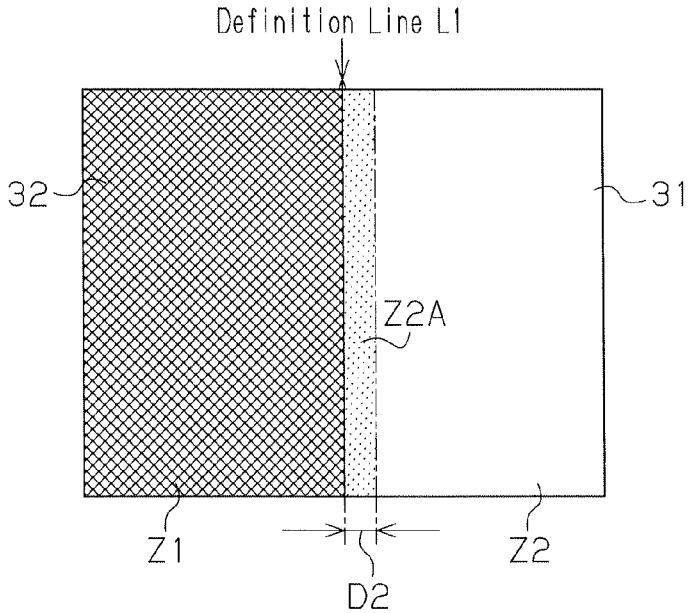
FIG. 5 is a plan view illustrating a printing zone and a non-printing zone (including an allowance range)

As illustrated in FIG. 4, light was radiated onto each of the printing samples 30 by a fluorescent lamp 33 from the side corresponding to the printing film 32. In evaluation, the position of the eye 34 of the evaluator was fixed at a position spaced from the printing sample 30 by a predetermined distance D1 (which was, for example, 20 cm) at the side opposite to the fluorescent lamp 33 with respect to the printing sample 30. In this state, with reference to FIGS. 3 and 5, the boundary between a printing zone Z1 on the front surface of the base material 12 including the printing film 32 and a non-printing zone Z2 without the printing film 32, which was a definition line L1, was visually evaluated.

When a droplet is received in the non-printing zone Z2, in which the printing film 32 is not to be formed, it may be determined that the droplet has missed the target position. However, as long as the droplet reaches a position in the proximity of the definition line L1 in the non-printing zone Z2, it may be considered that influence on the definition line L1 is only limited. Accordingly, when a droplet reached a position in a range in the non-printing zone Z2 spaced from the definition line L1 only by a predetermined distance D2 (which was, for example, 0.3 mm), or, in other words, a position in an allowance range Z2A represented in FIG. 5, the droplet was considered to have been received substantially in the printing zone Z1.

When no droplets were found in the range in the non-printing zone Z2 other than the allowance range Z2A, it was determined that the droplets reached a target position or a position in the vicinity of the target position. In contrast, when a droplet was found in the range in the non-printing zone Z2 other than the allowance range Z2A, it was determined that the droplet has missed the target position or a position in the proximity of the target position.

For the cases in which it was determined that the droplets reached the target position, the lower limit of the droplet amount Y was determined for the respective distances X. The equation (1) was thus obtained as the equation representing the relationship between the distance X and the droplet amount Y. The characteristic line in FIG. 2 represents the relationship between the distance X and the droplet amount Y.

The inkjet printer 20 may include a mechanism for moving the ink head 22 and the base material 12 relative to each other only in the first direction separately from a mechanism for moving the ink head 22 and the base material 12 relative to each other only in the second direction.

An ultraviolet radiation device (not shown) is arranged behind the ink head 22, or, in other words, behind the ejecting portions 21 that proceed in the first direction. The ultraviolet radiation device radiates ultraviolet rays onto ink droplets 24 on the printing surface 16. As a result, the droplets 24 cure and become fixed on the base material 12. A device including a light source lamp such as a high pressure mercury lamp or a metal halide lamp and a radiator (a lamp housing) is employed as the ultraviolet radiation device.

A decorative printing method for forming the printing film 17 on the printing surface 16 of the base material 12 using the inkjet printer 20 will hereafter be described.

As illustrated in FIGS. 1 and 6, when decorative printing is performed, the peripheral portion 13 of the base material 12 is maintained horizontal by the holding portion of the inkjet printer 20. In this state, the position of each nozzle 23 is set at a position spaced upward from the peripheral portion 13, or the flat surface portion 16A, by the distance $\alpha$ (which is, for example, 2 mm). In the printing surface 16 of the base material 12, the maximum depth of the non-flat surface portion 16B is approximately 10 mm (which may be for example, 8 mm). As a result, the distance X (the maximum distance) from the nozzles 23 to the maximally spaced position on the printing surface 16 is ten to ten-odd millimeters (for example, 10 mm). The droplet amount Y of the ink mixture ejected by each nozzle 23 is slightly greater than the value obtained by the equation (1) and, actually, 35 pl.

Subsequently, as the ink head 22 is reciprocated in the first direction and moved in the second direction perpendicular to the first direction on the horizontal plane HS, which is spaced upward from the flat surface portion 16A by the predetermined distance $\alpha$ (=2 mm), droplets 24 of the ink mixture are ejected from the nozzles 23 onto the printing surface 16.

The droplet amount Y set using the equation (1) is greater than a typical droplet amount (6 pl to 20 pl) set for a case in which the printing surface 16 is formed simply by a flat surface portion. As the droplet amount Y increases, the weight of the droplet 24 rises and kinetic energy $1/2\ mv^2$ (m: mass, v: velocity) of the droplet 24 increases. Accordingly, as the distance X increases, the traveling distance and the traveling time of each droplet 24 lengthens and the influence on the droplet 24 by the resistance of air or wind increases. However, by increasing the droplet amount Y as has been described, the kinetic energy of the droplet 24 is increased, thus allowing the droplet 24 to travel against resistance from air or wind. This causes the droplet 24 to reach the target position or a position in the proximity of the target position on the printing surface 16. As a result, the variation range of the droplet receiving position of the droplet 24 is reduced in size compared to that of a case in which the amount of an ejected droplet is smaller than the droplet amount Y determined by the equation (1).

Immediately after the droplet 24 is received by the printing surface 16, the ultraviolet rays are radiated onto the droplet 24 by the light source lamp of the ultraviolet radiation device. As a result, the droplets 24 rapidly cure so that the printing film 17, which has a thickness of approximately 10 μm, is formed on the printing surface 16.

As has been described, the base material 12 is formed of the synthetic resin having a low ink permeability. Accordingly, a great amount of ink in the droplets 24 stays on the printing surface 16 without permeating through the printing surface 16. Also, as the droplet amount Y increases, it becomes more difficult for the droplets 24 to mix with one another on the printing surface 16, and the droplets 24 remain independent from one another. Specifically, the droplets 24 cure before sufficiently mixing with one another.

Figure 7A:
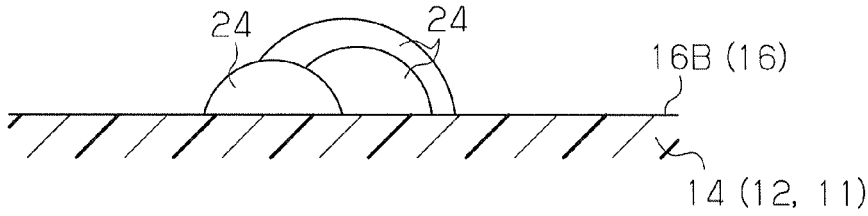
FIG. 7A is a cross-sectional view illustrating ink droplets of a single color that are cured independently from one another after having been received by a printing surface.

As illustrated in FIG. 7A, when droplets 24 of different colors are received at one point on the printing surface 16, the droplets 24 do not mix easily with one another. This prevents the color of the printing film 17, which is formed by a group of droplets 24, from becoming uniform. As a result, color variation may occur in the printing film 17.

However, the present embodiment employs the ink mixture, which is formed by mixing ink of multiple colors in advance. The ink mixture is ejected as droplets 24 from the nozzles 23. As a result, by the time when the droplets 24 reach the printing surface 16 of the base material 12 having the low ink permeability, inks of different colors have been mixed. This ensures a uniform color of the printing film 17 without mixing the droplets 24 together after the droplets 24 are received by the printing surface 16.

The base material 12 is formed of transparent polycarbonate. Accordingly, when the printing target 11 is viewed from the front surface, the printing film 17 formed on the printing surface 16 is visible through the base material 12.

Figure 7B:
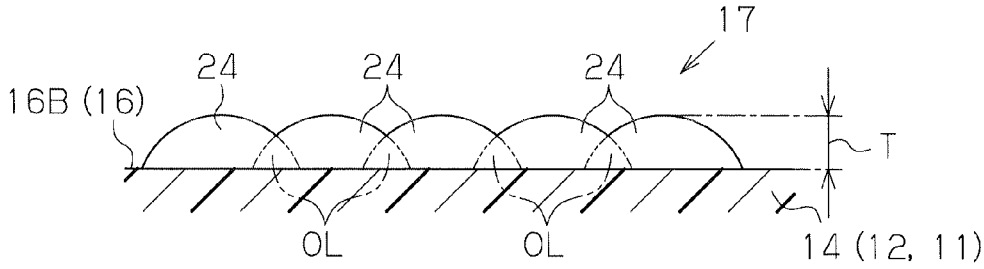
FIG. 7B is a cross-sectional view illustrating a printing film formed by droplets of ink mixture received by a printing surface.
Figure 8:
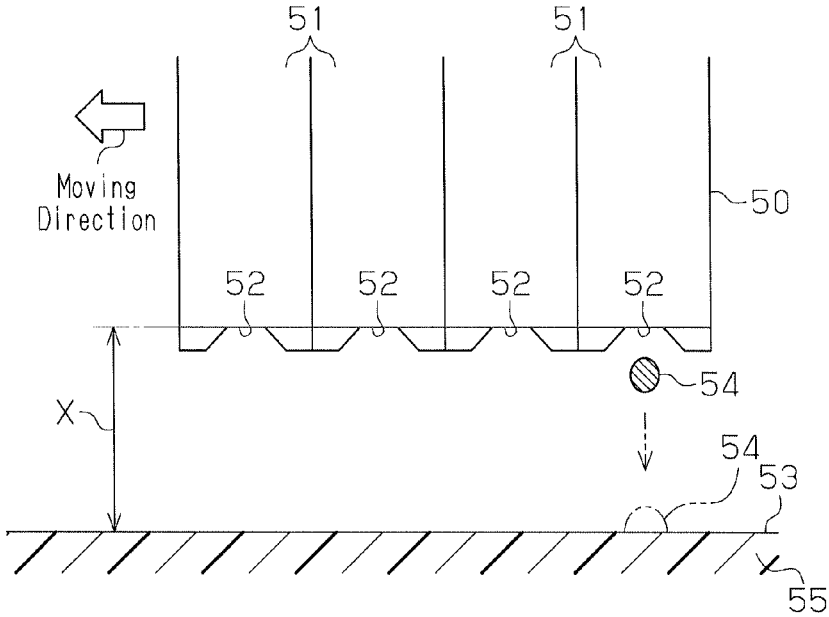
Fig.8 Prior Art
FIG. 8 is a cross-sectional view illustrating printing on a flat printing surface by conventional inkjet printing.
Figure 9:
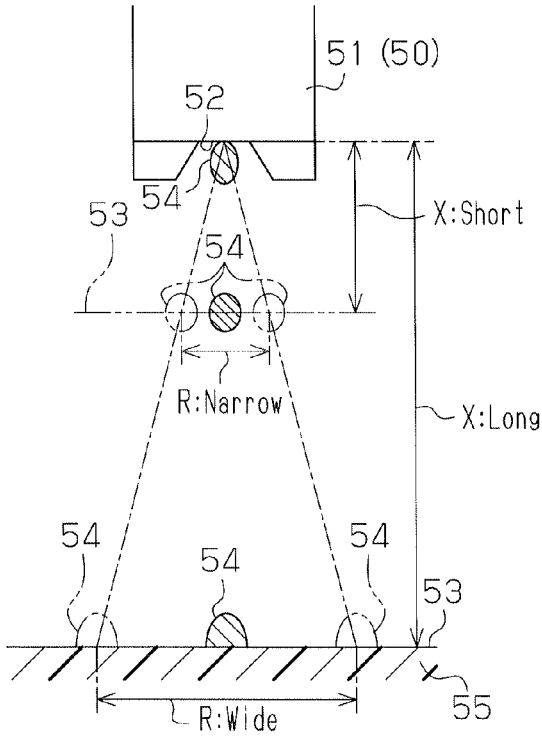
Fig.9 Prior Art
FIG. 9 is a schematic view illustrating a variation range of an ink receiving position in printing on a non-flat printing surface by the conventional inkjet printing.

In this case, if the droplet amount Y is increased to 35 pl, overlapped portions OL are each formed between each adjacent pair of droplets 24 received by the printing surface 16, as illustrated in FIG. 7B. This prevents formation of a gap between each adjacent pair of droplets 24. Also, the increased droplet amount Y increases the thickness T of the printing film 17 to approximately 10 μm. This prevents the printing film 17 from becoming transparent, and increases the opacity of the printing film 17. Further, compared to a case in which gaps are formed between adjacent droplets 24, the extent of variation in the thickness T of the printing film 17 is lowered.

The present embodiment, which has been described in detail, has the advantages described below.

(1) The ink mixture, which is formed by mixing ink of multiple colors in advance, is ejected from the nozzles 23 of the inkjet printer 20. The distance from the nozzles 23 to the printing surface 16 is represented by the distance X (mm). The amount of the ink in each droplet ejected by the nozzles 23 is represented by the droplet amount Y (pl). When the maximum value of the distance X is greater than 5 mm, each droplet 24 is ejected from the nozzle 23 by an amount greater than the droplet amount Y, which is represented by equation (1).

In this case, the ink ejection amount is set to a value greater than the typical amount of a droplet 24, which is set for the case in which the printing surface 16 is a flat surface. This increases the weight of each ejected ink droplet 24 and raises the kinetic energy $1/2\ mv^2$ (m: mass, v: velocity. Specifically, when the distance X exceeds 5 mm, the traveling distance and the traveling time of each droplet 24 prolonged and the resistance from air rises to increase the influence from wind. However, the above-described increased weight of the ejected droplet 24 allows the ink droplet 24 to travel against the resistance from air and the influence from wind, and accurately reach the target position on the printing surface 16 or a position in the proximity of the target position. This ensures uniform color of the printing film 17 and forms a clear definition for the printing zone Z1. The present invention is designed for a configuration in which that droplets 24 having the same color as the color of the printing film 17 are ejected from the nozzles 23. In other words, the invention excludes a case in which ink droplets 24 of multiple colors different from the color of the printing film 17 are ejected and then mixed together on the printing surface 16 to form the color of the printing film 17.

If the ejection amount of each ink droplet 24 increases, the droplets 24 do not mix easily with one another and thus remain mutually independent on the printing surface 16. As a result, if droplets 24 of different colors are received at one point on the printing surface 16 or a position in the vicinity of one point, the droplets 24 do not sufficiently mix with one another, thus causing color variation on the printing surface 16. However, in the present invention, the ink mixture formed by mixing ink of multiple colors in advance is employed. Accordingly, by the time when the droplets 24 are received by the surface to be printed 16 of the base material 12, the ink of the multiple colors are completely mixed. This ensures uniform color of the printing film 17 without mixing the droplets 24 after the droplets 24 are received by the surface to be printed 16.

(2) The distance X is set to 10 mm and each droplet 24 is ejected by the amount (35 pl) greater than the droplet amount Y represented by the equation (1). This prevents a gap from being formed between each adjacent pair of the droplets 24 on the printing surface 16. Also, the thickness of the printing film 17 is increased to approximately 10 μm. The printing film 17 is thus prevented from becoming transparent and has an increased opacity. Additionally, variation of the thickness T of the printing film 17 decreases and color variation of the printing film 17 is prevented.

(3) To improve droplet ejection accuracy and, additionally, ensure opacity of the printing film 17, the droplet amount Y is preferably greater than or equal to 25 pl and, more preferably, greater than or equal to 30 pl. However, if the droplet amount Y exceeds an optimal value, large-sized droplets are received by the printing surface 16. This forms a non-uniform surface on the printing film 17, thus causing thickness variation in the printing film 17. Also, color variation occurs in the printing film 17. To ensure uniform thickness of the printing film 17 and prevent the color variation, the droplet amount Y is preferably smaller than or equal to 90 pl and, more preferably, smaller than or equal to 80 pl.

(4) The base material 12 is formed of transparent polycarbonate. The front surface of the base material 12 forms the decorative surface 15 of the ornament 11. The back surface of the base material 12 forms the printing surface 16. Accordingly, when the printing target 11 is viewed from the front surface, the printing film 17 formed on the printing surface 16 is visible through the base material 12 in a three dimensional manner.

The present invention may be embodied in the other forms described below.

<Base Material 12>

Acrylic resin or the like may be used as the transparent resin forming the base material 12.

The base material 12 may be formed of wood, metal, or ceramic.

<Printing Film 17>

The decorative surface 15 of the base material 12 may be employed as the printing surface 16 which the printing film 17 is formed. In this case, the base material 12 does not necessarily have to be transparent.

Using two or more types of ink mixtures having different colors, the printing film 17 may be formed in the manner described below. Specifically, in the boundary between two adjacent printing films 17, the proportion of the droplets 24 per unit surface area is gradually changed from one of the printing films 17 toward the other, thus causing gradual color change. This provides an expensive-looking decorative surface with color gradation.

The printed pattern formed by the printing film 17 may be a wood grain pattern or a stone pattern (a marble pattern), other than a character (or characters), an image, or a combination thereof.

<Other Items>

The present invention may be used for both a printing target 11 in which a portion of the printing surface 16 is a non-flat surface portion 16B and for a printing target 11 in which the printing surface 16 as a whole is a non-flat surface portion 16B.

The present invention may be used in a case in which ink mixture is ejected from a single nozzle 23 to form a printing film 17 of a single mixed color. In this case, the surface adjacent to the printing surface 16 may be either transparent or non-transparent. When the surface is non-transparent, a metallic glossy portion may be formed on the printing surface 16 through plating or vapor deposition in order to provide an expensive looking decorative surface.

To improve abrasion resistance, solvent resistance, and chemical resistance, a transparent surface protecting layer may be formed on the printing film 17.

A printing target according to the present invention may be a member different from a decorative member for a vehicle.

To obtain the color of the printing film 17 by mixing multiple colors of ink, an ink mixture is ejected from the nozzles 23. To bring about the color of the printing film 17 using a single color of ink, in contrast, a single color of ink may be ejected from the nozzles 23. Also in this case, by ejecting, from the nozzles 23, the droplets 24 each by an amount greater than the droplet amount Y represented by equation (1), the operation and the advantages that are similar to those of the illustrated embodiment are ensured. In other words, equation (1) is usable for a case in which a single color of ink is used. Specifically, any suitable ink may be used as long as the ink has the same color as the color of the printing film 17 when ejected from the nozzles 23.

The invention claimed is:

1. A decorative printing method for forming a printing film on a surface to be printed of a printing target formed by a base material, the method comprising ejecting droplets of ink having the same color as the color of the decorative printing film from nozzles of an inkjet printer onto the surface to be printed to form the printing film, in which a non-flat surface portion forms at least a portion of the surface to be printed, wherein:

the distance from each nozzle to the surface to be printed is represented by X (mm) and the amount of ink of each droplet is represented by Y (pl);

the droplet amount Y is represented by the equation: $Y=0.9X^{1.5}$; and when the maximum value of the distance X (mm) is greater than 5 mm, droplets each having an amount greater than the droplet amount Y are ejected from each nozzle.

2. The decorative printing method according to claim 1, wherein an ink mixture formed by mixing ink of different colors in advance is ejected from the nozzles.

3. The decorative printing method according to claim 1, wherein a front surface of the base material is a decorative surface, a back surface of the base material is the surface to be printed, with the base material being formed of a transparent material.

4. The decorative printing method according to claim 1, wherein the base material is formed of resin.

5. The decorative printing method according to claim 1, wherein the printing target is a decorative member for an automobile.

* * * * *